US010150329B2

(12) United States Patent
Romero

(10) Patent No.: US 10,150,329 B2
(45) Date of Patent: Dec. 11, 2018

(54) SUPPORT STRUCTURE FOR HANGING FILE FOLDERS

(71) Applicant: William E. Romero, Dix Hills, NY (US)

(72) Inventor: William E. Romero, Dix Hills, NY (US)

( * ) Notice: Subject to any disclaimer, the term of this patent is extended or adjusted under 35 U.S.C. 154(b) by 0 days.

(21) Appl. No.: 15/707,782

(22) Filed: Sep. 18, 2017

(65) Prior Publication Data

US 2018/0001693 A1 Jan. 4, 2018

Related U.S. Application Data

(63) Continuation-in-part of application No. 15/055,540, filed on Feb. 27, 2016, now Pat. No. 9,764,587, which is a continuation of application No. 13/896,477, filed on May 17, 2013, now Pat. No. 9,272,566.

(51) Int. Cl.
*B42F 15/00* (2006.01)

(52) U.S. Cl.
CPC ..... *B42F 15/0094* (2013.01); *Y10T 403/7164* (2015.01)

(58) Field of Classification Search
CPC .. B42F 15/00; B42F 15/0094; B42F 15/0082; Y10T 403/75; Y10T 403/7164; A47B 63/00
USPC ..... 211/46
See application file for complete search history.

(56) References Cited

U.S. PATENT DOCUMENTS

| | | | | |
|---|---|---|---|---|
| 2,871,861 A * | 2/1959 | Posner | B42F 15/0094 | 126/30 |
| 3,788,718 A * | 1/1974 | Bjorn | A47B 63/00 | 211/184 |
| 3,860,119 A * | 1/1975 | Irvine | B42F 15/0094 | 211/175 |
| 4,262,810 A * | 4/1981 | Ilich | B42F 15/0094 | 211/206 |
| 5,515,980 A * | 5/1996 | Fotioo | B42F 15/0094 | 211/189 |
| 5,531,464 A * | 7/1996 | Maurer | B62B 3/00 | 211/126.15 |

* cited by examiner

*Primary Examiner* — Ko H Chan
(74) *Attorney, Agent, or Firm* — Franco S. De Liguori; DP IP Group

(57) ABSTRACT

A support structure has two side panels and two support frame assemblies maintaining the side panels in a mutually spaced relationship and at an elevation to enable suspension of hanging file folders from upper surfaces of the side panels. Each side panel has a top member having the upper surface and a bottom member spaced apart from the top member. Terminal ends of each of the top and bottom members are provided with vertical slots. Each support frame assembly has two support legs that extend into the vertical slots of the respective terminal ends of the side panels and has a transverse support member having opposite terminal ends releasably mounted to respective ones of the support legs. Each support leg has first and second leg portions spaced apart from one another by a bend serving as a seat that positions and holds the transverse support member.

20 Claims, 14 Drawing Sheets

SUPPORT STRUCTURE FOR HANGING FILE FOLDERS

CROSS-REFERENCE TO RELATED APPLICATIONS

This application is a continuation-in-part of application Ser. No. 15/055,540, filed Feb. 27, 2016, which is a continuation of application Ser. No. 13/896,477, filed May 17, 2013, now U.S. Pat. No. 9,272,566.

BACKGROUND OF THE INVENTION

Field of the Invention

The present invention relates generally to support structures arranged to support or suspend other articles, and specifically, to a support structure for mounting within a file drawer to support hanging file folders therein.

Background Information

Hanging or suspension type folder systems employ some type of support structure having a pair of spaced rails from which file folders are hung by cross members adapted for resting upon, and slide along, the rails. This type of support structure is designed to be placed in a conventional file drawer or cabinet.

Various types of hanging file folder support structures have been proposed, including in those of U.S. Pat. No. 4,526,277, U.S. Pat. No. 4,049,127, U.S. Pat. No. 4,030,610, U.S. Pat. No. 3,999,663, U.S. Pat. No. 3,860,119, U.S. Pat. No. 3,788,718, and U.S. Pat. No. 3,734,300. However, these proposed structures are rather complex, costly to manufacture, and/or cumbersome to utilize. In particular, the foregoing support structures do not appear to be suitable, in terms of strength and rigidity, for supporting heavy loads of hanging file folders.

Thus, despite the number and variety of disclosures relating to hanging file folder support structures, such as those noted above, none are believed to provide satisfactory solutions to problems relating to ease and economy of construction and assembly, and to strength and rigidity of the components forming the support structures.

The present invention addresses the foregoing problems and disadvantages of conventional hanging file folder support structures.

SUMMARY OF THE INVENTION

It is an object of the present invention to provide a support structure for hanging file folders which may be readily assembled into a strong, rigid structure which is self-supporting and self-retaining in use so as to be extremely efficient and sturdy for the supporting of hanging file folders.

It is another object of the present invention to provide a support structure for hanging file folders which may be easily and readily assembled and disassembled by a user without requiring special tools.

It is a further object of the present invention to provide a support structure for hanging file folders which can be manufactured economically from a small number of separate components.

It is yet another object of the present invention to provide a support structure for hanging file folders that can be shipped and stored in compact, knock-down form and is capable of easy and rapid assembly into a rigid structure for use.

The foregoing and other objects of the present invention are carried out by a support structure comprising a pair of elongate side panels configured for suspending hanging file folders from upper surfaces thereof, and a pair of end support frame assemblies for maintaining the pair of side panels in a mutually spaced relationship and at an elevation to enable suspension of the hanging file folders therefrom. Each of the side panels includes a top member having the upper surface, a bottom member spaced apart from the top member, and at least one reinforcing member interconnecting the top and bottom members, each of the top and bottom members having opposite terminal ends each formed as a connecting member having a vertical slot. Each of the end support frame assemblies includes a pair of support legs configured to removably extend through the vertical slots of the respective side panel connecting members and at least one transverse support member having opposite terminal ends configured to be releasably mounted to respective ones of the pair of support legs.

According to a feature of the present invention, each of the support legs of each of the end support frame assemblies has upper and lower portions. The support structure further comprises, for each of the end support frame assemblies, means for positioning the at least one transverse support member relative to the support legs and for preventing the at least one transverse support member from displacing in a direction toward the lower portions of the support legs.

In one exemplary embodiment, the side panels are identical in dimension and construction to one another, and the at least one transverse support member of each of the end support frame assemblies are identical in dimension and construction to one another. Each of the interconnecting panels is configured to be releasably mounted to the respective pair of support legs so that the support legs extend through the vertical slots of respective connecting members of the interconnecting panels.

In another exemplary embodiment, the at least one transverse support member of each of the end support frame assemblies comprises at least one rod-shaped member.

In yet another exemplary embodiment, the at least one reinforcing member of each of the first and second side panels comprise a plurality of vertical reinforcing members connected between the top and bottom members.

In a further exemplary embodiment, the at least one reinforcing member of each of the first and second side panels comprises an arc-shaped reinforcing member connected between the top and bottom members.

In yet another exemplary embodiment, for each of the support legs, the means for positioning the at least one transverse support member relative to the support legs and for preventing the at least one transverse support member from displacing in a direction toward the lower portions of the support legs comprises a seat or rest portion of the support leg disposed between the upper and lower portions thereof.

BRIEF DESCRIPTION OF THE DRAWINGS

The foregoing summary, as well as the following detailed description of the preferred embodiments of the invention, will be better understood when read in conjunction with the accompanying drawings.

DETAILED DESCRIPTION OF THE PREFERRED EMBODIMENTS

Figure 1:
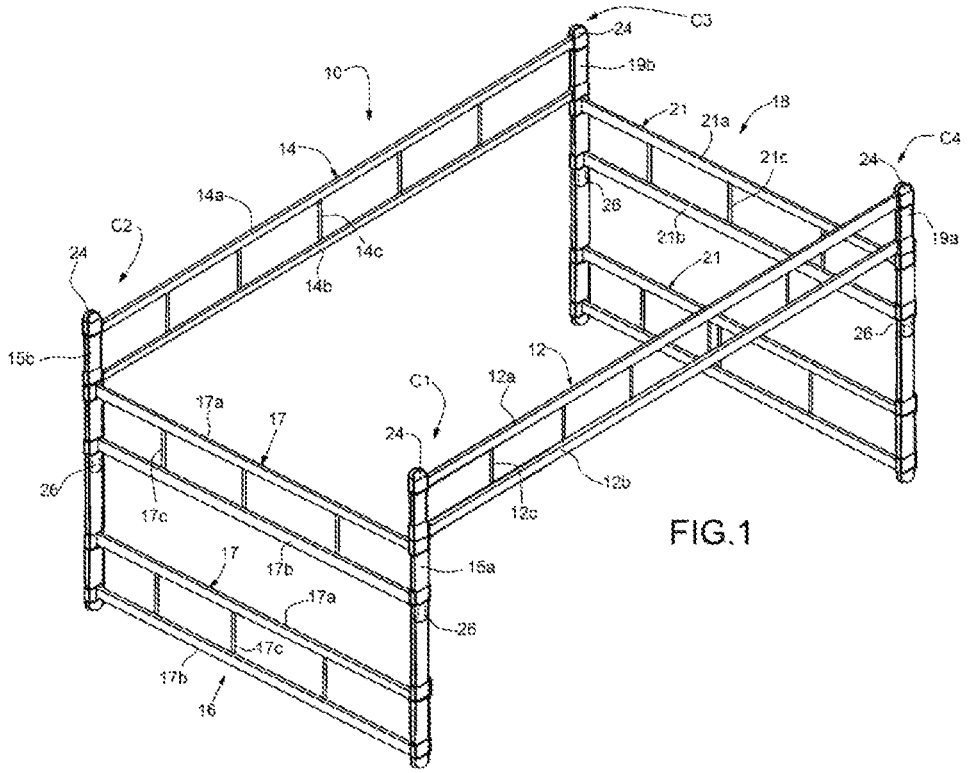
FIG. 1 is a perspective view showing an arrangement of the support structure for hanging file folders according to one embodiment of the present invention as assembled for use.

While this invention is susceptible of embodiments in many different forms, this specification and the accompanying drawings disclose only presently preferred embodiments of the invention. The invention is not intended to be limited to the embodiments so described, and the scope of the invention will be pointed out in the appended claims.

Certain terminology is used in the following description for convenience only and is not intended to be limiting. The words right, left, front, rear, back, top, bottom, upper, lower, inner, outer, rearwardly and forwardly designate directions in the drawing to which reference is made. Such terminology includes the words above specifically mentioned and words of similar import.

Figure 2:
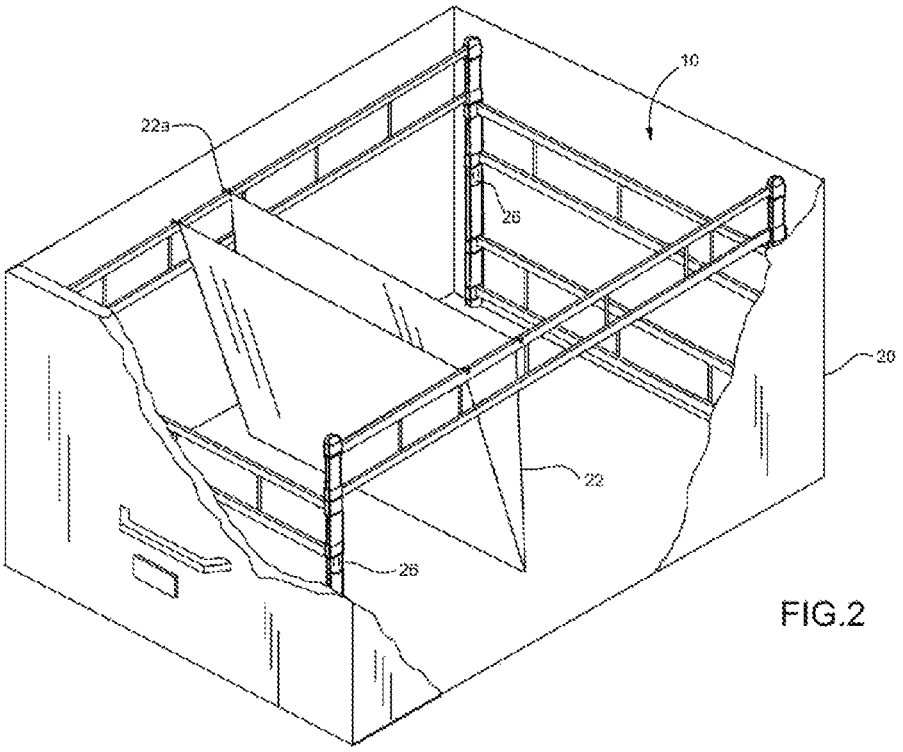
FIG. 2 is a perspective view of a file drawer, partially cut away, showing the support structure for hanging file folders in FIG. 1 during use.
Figure 3:
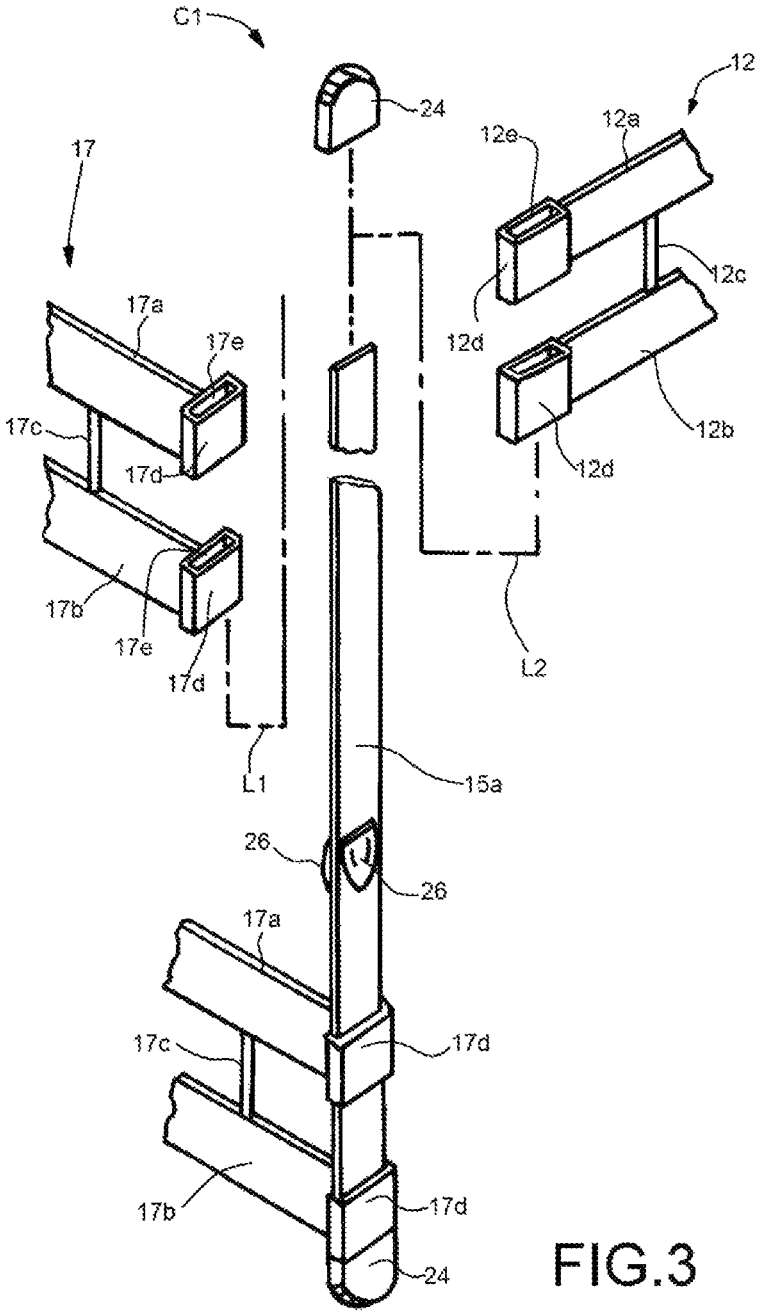
FIG. 3 is an expanded view of a portion of the arrangement in FIG. 1 shown disassembled and partially cut away for further detail.

Referring now to the drawings in detail, wherein like numerals are used to indicate like elements throughout, there is shown in FIGS. 1-3 an exemplary embodiment of a support structure for hanging file folders, generally designated at 10, according to the present invention. The support structure 10 is formed of interlocking components including a pair (first and second) of elongate side panels 12, 14 and a pair (first and second) of end support frame assemblies 16, 18 removably connected together to form an open box-type structure having four corner sections C1-C4 and configured to be placed in a conventional file drawer, such as the unit 20 of FIG. 2, and provided with hanging file folders (file pockets) 22 for the storage of files therein. The hanging file folders 22 are provided with support elements 22*a* for slidably engaging the side panels 12, 14 so that the hanging file folders 22 may be moved to various positions on the support structure 10 and may be inserted and removed as desired. For clarity, the unit 20 is shown partially cut away to illustrate the positioning of the support structure 10 inside of the unit 20. According to the embodiment of the present invention shown in FIGS. 1-3, the first and second end support frame assemblies 16, 18 are identical in construction and dimension to one another, and the first and second side panels 12, 14 are identical in construction and dimension to one another, as set forth in more detail below.

The first end support frame assembly 16 includes a pair of first support legs 15*a*, 15*b* and upper and lower first transverse support members 17 releasably mounted to respective ones of the first support legs 15*a*, 15*b*. The second end support frame assembly 18 is disposed in spaced-apart relationship to the first end support frame assembly 16 and includes a pair of second support legs 19*a*, 19*b* and upper and lower second transverse support members 21 releasably mounted to respective ones of the second support legs 19*a*, 19*b*. The support legs 15*a*, 15*b*, 19*a*, 19*b* are identical in dimension and construction to one another.

Each of the first transverse members 17 has a top member 17*a*, a bottom member 17*b* spaced apart from the top member 12*a*, and reinforcing members 17*c* interconnecting the top and bottom members 17*a*, 17*b*. Each of the top and bottom members 17*a*, 17*b* has opposite (first and second) terminal ends. Similarly, each of the second transverse support members 21 has a top member 21*a*, a bottom member 21*b* spaced apart from the top member 21*a*, and reinforcing members 10 21*c* interconnecting the top and bottom members 21*a*, 21*b*. Each of the top and bottom members 21*a*, 21*b* has opposite (first and second) terminal ends.

The first and second side panels 12, 14 are adapted to span the distance between the first and second end support frame assemblies 16, 18. The first side panel 12 has a top member 12*a* for releasably supporting one of two ends of the support element 22*a* of the hanging file folder 22, a bottom member 12*b* spaced apart from the top member 12*a*, and reinforcing members 12*c* interconnecting the top and bottom members 12*a*, 12*b*. Each of the top and bottom members 12*a*, 12*b* has opposite (first and second) terminal ends. Similarly, the second side panel 14 has a top member 14*a* for releasably supporting the other of the two ends of the support element 22*a* of the hanging file folder, a bottom member 14*b* spaced apart from the top member 14*a*, and reinforcing members 14*c* interconnecting the top and bottom members 14*a*, 14*b*. Each of the top and bottom members 14*a*, 14*b* has opposite (first and second) terminal ends.

The specific construction of the first terminal ends of the side panel 12 and the transverse members 17 will be described below with reference to FIG. 3 in connection with the construction of the corner section C1 of the support structure 10. It will be understood, however, that the construction of the components for each of the corner sections C2-C4 of the support structure 10, including the second terminal ends of the first side panel 12 and the transverse members 17, the first and second terminal ends of the second side panel 14 and the transverse members 21, and the support legs 15*a*, 15*b*, 19*a*, 19*b*, are identical to those as described below for the corner section C1.

FIG. 3 is an expanded, exploded view of the corner section C1 of the support structure 10 shown in FIG. 1. The corner section C1 is assembled by mounting the first terminal ends of the top and bottom members 12*a*, 12*b* of the first side panel 12 and first terminal ends of the top and bottom members 17*a*, 17*b* of each of the upper and lower first transverse support members 17 on the first support leg 15*a*. For clarity of illustration, the first side panel 12 and first transverse support members 17 are shown partially cut away to illustrate details of the first terminal ends of these components that are removably mounted and secured on the first support leg 15*a*.

The first terminal end of each of the top and bottom members 12*a*, 12*b* of the first side panel 12 is formed as a connecting member 12*d* having a vertical slot 12*e* releasably receiving therethrough the first support leg 15*a*. Likewise, the first terminal end of each of the top and bottom members 17*a*, 17*b* of the first transverse support members 17 is formed as a connecting member 17*d* having a vertical slot 17*e* for releasably receiving therethrough the first support leg 15*a*. Each of upper and lower ends of the first support leg 15*a* is covered with a cover or shoe member 24. The cover members 24 are configured to be removably secured to the respective upper and lower ends of the first support leg 15*a* with a friction fit.

Each of the connecting members 12*d*, 12*e* and 17*d*, 17*e* is generally rectangular-shaped in cross-section. The top and bottom members 12*a*, 12*b* of the first side panel 12 are attached to generally central portions of short sides of the rectangle shapes of the respective connecting members 12*d*, 12*e* (i.e., the long sides of the rectangle shapes of the connecting members 12*d*, 12*e* extend along longitudinal directions of the respective top and bottom members 12*a*, 12*b*). The top and bottom members 17*a*, 17*b* of the first transverse support member 17 are attached to generally central portions of long sides of the rectangle shapes of the respective connecting members 17*d*, 17*e* (i.e., the short sides of the rectangle shapes of the connecting members 17*d*, 17*e* extend along longitudinal directions of the respective top and bottom members 17*a*, 17*b*). Stated otherwise, in the present embodiment each of the top member 17*a* and corresponding connecting members 17*d* and the bottom member 17*b* and corresponding connecting members 17*d* is configured as a structure having a generally I-shape in longitudinal cross-section.

In addition to providing structural integrity, a primary reason for the difference in orientation between the connecting members 12*d* relative to the top and bottom members 12*a*, 12*b* of the first side panels 1 and the connecting members 17*d* relative to the top and bottom members 17*a*, 17*b* of the first transverse support members 17, a set forth above, is to permit the assembly of the first side panel 12 and transverse support members 17 on the support leg 15*a* to form the corner section C1 as shown in FIG. 1.

It will be appreciated that the orientations of the connecting members relative to the side panel 12 and transverse support members 17 as described above may be reversed, provided that the orientation of the support leg 15*a* is adjusted by 90 degrees from the position shown in FIGS. 1 and 3. More specifically, in the embodiment of FIGS. 1 and 3, the support leg 15*a* is formed of a flat strip of material having opposite main surfaces. The support leg 15*a* is positioned such that each of the top and bottom members 17*a*, 17*b* of the transverse support members 17 extend generally perpendicular to the main surfaces of the support leg 15*a*. Thus, reversal of the orientation of the connecting members relative to the side panel 12 and transverse support members 17 would result in each of the top and bottom members 12*a*, 12*b* of the side panel 12 being generally perpendicular to the main surfaces of the support leg 15*a*.

The first support leg 15*a* is provided with indentations 26 formed on opposite surfaces and disposed approximately at a central portion of the first support leg 15*a* in the longitudinal direction thereof. The indentations 26 serve to position and retain the upper first transverse support member 17 relative to the first support leg 15*a* so as to prevent the upper first transverse support member 17 from displacing in a direction toward the lower end of the first support leg 15*a*.

An example of the manner of assembling the corner section C1 of the support structure 10 is described with reference to FIGS. 1 and 3.

The lower first transverse support member 17 is mounted on the first support leg 15*a* by passing the first support leg 15*a*, from the lower end thereof, through the vertical slot 17*e* of each of the connecting members 17*d* at the first terminal end of the lower first transverse support member 17. One of the cover members 24 is then secured to the lower end of the first support leg 15*a* to position and retain the lower first transverse support member 17 on the first support leg 15*a*. The upper first transverse support member 17 is then mounted on the first support leg 15*a* bypassing the first support leg 15*a*, from the upper end thereof, through the vertical slot 17*e* of each of the connecting members 17*d* at the first terminal end of the upper first transverse support member 17, as denoted by chain link line L1 in FIG. 3. In this state, the upper first transverse support member 17 is displaced along the first support leg 15*a* until the connecting member 17*d* of the bottom member 17*b* firmly engages and rests on the indentations 26 of the first support leg 15*a*. Thereafter, the first side panel 12 is mounted on the first support leg 15*a* by passing the first support leg 15*a*, from the upper end thereof, through the vertical slot 12*e* of each of the connecting members 12*d* at the first terminal end of the first side panel 12, as denoted by chain link line L2 in FIG. 3. In this state, the first side panel is displaced along the first support leg 15*a* until the connecting member 12*d* of the bottom member 12*b* firmly engages and rests on against the connecting member 17*d* of the top member 17*a* of the upper first transverse support member 17. Lastly, another of the cover members 24 is then releasably secured to the upper end of the first support leg 15*a* with friction fit to securely anchor the first side panel 12 between the cover member 24 and the upper first transverse support member 17. This assembly operation is both simple and quick. The completely assembled corner section C1 of the support structure 10, including the first side panel 12 and the upper and lower first transverse support members 17 mounted on the first leg 15*a*, is shown in FIG. 1.

It will be appreciated that in the assembled configuration of the corner section C1 shown in FIG. 1, the indentations 26 formed on the first support leg 15*a* serve to position and retain the first terminal ends (i.e., connecting members 17*d*) of the top and bottom members 17*a*, 17*b* of the upper first transverse support member 17 on the first support leg 15 so as to prevent displacement thereof toward the lower end of the first support leg 15*a*. Furthermore, the first terminal end (i.e., connecting member 12*d*) of the bottom member 12*b* of the first side panel 12 rests on the first terminal end (i.e., connecting member 17*d*) of the top member 17*a* of the upper first transverse member 17 and is retained in place by the cover member 24 covering and engaging the upper end of the first support leg 15*a* with friction fit. Thus, the first terminal ends of the top and bottom members of each of the first side panel 12 and the upper first transverse member 17 are firmly retained in place and prevented from undergoing upward and downward movement along the first support leg 15*a*. It will also be appreciated that the cover member 24 covers and engages the lower end of the first support leg 15*a* with sufficient frictional fit so as to prevent the first terminal ends of the top and bottom members 17*a*, 17*b* of the lower first transverse member 17 from displacing in the direction toward the lower end of, and thereby be disengaged from, the first support leg 15*a*.

It will be understood by those skilled in the art that assembly of each of the corner sections C2-C4 of the support structure 10 can be accomplished using the same procedure described above for the assembly of the corner section C1. In this regard: the corner section C2 is assembled by mounting the first terminal ends of the top and bottom members 14*a*, 14*b* of the second side panel 14 and the second terminal ends of the top and bottom members 17*a*, 17*b* of each of the upper and lower first transverse support members 17 on the second support leg 15*b*; the corner section C3 is assembled by mounting the second terminal ends of the top and bottom members 14*a*, 14*b* of the second side panel 14 and the second terminal ends of the top and bottom members 21*a*, 21*b* of each of the upper and lower first transverse support members 21 on the second support leg 19*b*; and the corner section C4 is assembled by mounting the first terminal ends of the top and bottom members 12*a*, 12*b* of the second side panel 12 and the first terminal ends of the top and bottom members 21*a*, 21*b* of each of the upper and lower first transverse support members 21 on the first support leg 19*a*.

From the foregoing description with reference to FIGS. 1-3, it will be appreciated that each of the first upper and lower transverse support members 17 are identical in construction and dimensions to each of the second upper and lower first transverse support members 21, and that the side panels 12, 14 are identical in construction to one another. Furthermore, each of the first and second upper and lower transverse support members 17, 21 are identical in construction to each of the side panels 12, 14, with the exception of the respective lengths thereof and the orientation of the respective connecting members as set forth above. More specifically, in this embodiment each of the side panels 12, 14 have a length greater than that of each of the first and second transverse support members 17, 21, thereby forming an open rectangular frame. It will be understood, however, that the relative dimensions between the side panels and transverse support members can be varied depending on the particular configuration of the support structure 10 desired, without departing from the spirit and scope of the invention. Likewise, the orientation between the connecting members between the side panels 12, 14 and the connecting members of the transverse support members 17, 21 may be reversed as set forth above.

Moreover, the configuration of the side panels 12, 14 and the transverse support members 17, 21, including the top and bottom members separated by the reinforcing members and including terminal ends formed with the connecting members having slots configured for receiving the respective support legs, advantageously serve to add rigidity to the support structure 10 by substantially reducing lateral stress on the corner sections C1-C4 of the support structure. Furthermore, any torsional stress that the support structure 10 is likely to encounter is resisted by virtue of the configuration of the side panels and the transverse support members and by these components being mounted on the respective support legs by passing the support legs through the respective slots of these components.

It will also be appreciated that assembly of the support structure 10 according to the embodiment of the invention shown in FIGS. 1-3 can be readily accomplished in a quick and detachable manner without the use of tools and without the need for screws or other extraneous fasteners. Furthermore, by the above construction, the side panels 12, 14 and the end support frame assemblies 16, 18 can be readily assembled to form the support structure either in the filing cabinet drawer 20 or out of the drawer for placement therein.

By providing each of the first and second terminal ends of the top and bottom members of each of the side panels and transverse support members with the connecting member having the vertical slot, and by providing the support legs with the indentations, these parts can be readily and securely mounted to the support legs to construct the corner sections of the support structure 10 so that the parts cannot be disassembled when handling the support structure during insertion into the file cabinet drawer 20 or when loaded with hanging folders 22. However, the construction of the support structure 10 according to the present invention allows it to be readily disassembled by hand for storage and to be reassembled for use in another file cabinet drawer.

Moreover, the support structure 10 can be constructed with a minimum number of parts as compared to conventional support structures for hanging file folders. This is made possible by the fact that each of the side panels 12, 14, transverse support members 17, 21, support legs 15*a*-15*b*, 19*a*-19*b* and cover members 24 has a unitary construction. In the particular embodiment shown in FIG. 1, the support structure 10 can be assembled into a stable, open frame configuration using just two side panels, four transverse support members, four support legs and eight cover members. Accordingly, it will be appreciated that the support structure 10 for hanging file folders may be readily and economically manufactured and later assembled by the user without the need for fasteners or specialized tools, as set forth above. The various parts of the support structure 10 according to the present invention is particularly adapted for packaging as a kit.

Preferably, the side panels 12, 14, transverse support members 17, 21 and support legs 15*a*-15*b* and 19*a*-19*b* of the support structure 10 are constructed from a metal, such as aluminum or steel, which may be in stamped, cast, machined or extruded form. For example, these parts may be fabricated from flat strip metal of uniform section with smooth edges throughout. Alternatively, these parts may be constructed of comparatively strong rigid plastic or other material. The cover or shoe members 24 are preferably made of rubber or similar material to protect the file drawer 20 from damage and/or the user from injury.

Figure 4:
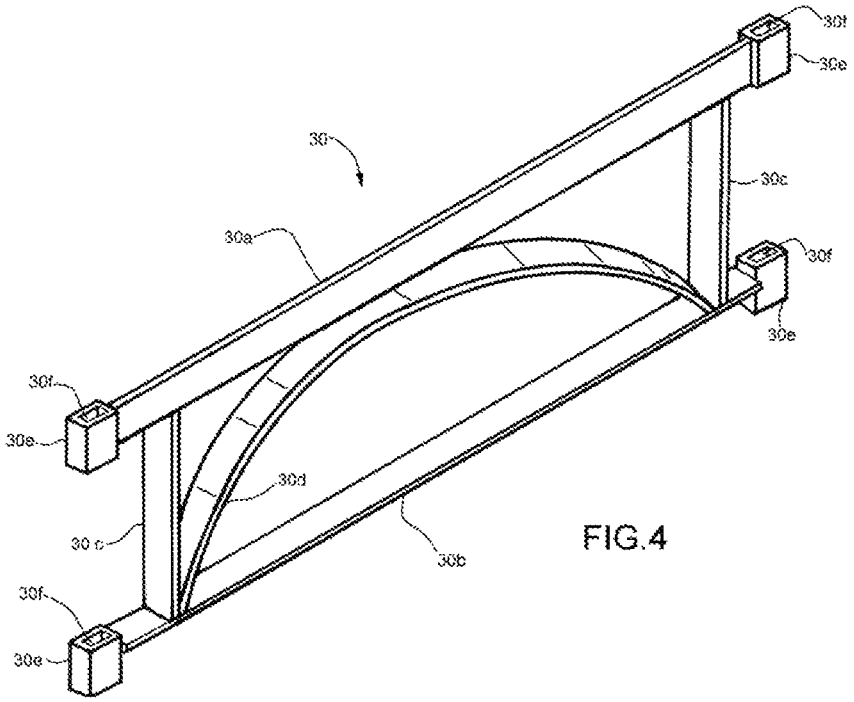
FIG. 4 is a perspective view of a modified form of the side panels for the support member shown in FIG. 1.

FIG. 4 illustrates another embodiment of the present invention showing a modified form of the side panels, generally designated at 30, for the support structure 10 according to the present invention.

The modified side panel 30 has a top member 30*a* for releasably supporting one of two ends of the support element 22*a* of the hanging file folder 22, a bottom member 30*b* spaced apart from the top member 12*a*, and reinforcing members 30*c*, 30*d* interconnecting the top and bottom members 30*a*, 30*b*. Each of the terminal ends of each of the top and bottom members 30*a*, 30*b* of the side panel 30 is formed as a connecting member 30*e* having a vertical slot 30*f* for releasably receiving therethrough one of the support legs 15*a*, 15*b*, 19*a* and 19*b* as described above for the embodiment of FIGS. 1-3. The top and bottom members 30*a*, 30*b* (other than the connecting members 30*e*) and the reinforcing members 30*c*, 30*d* are formed of generally flat strips of material. Any material as described above for the side panels 12, 14 of FIGS. 1-3 may be used for the side panel 30.

The reinforcing members 30*c* extend vertically between the top and bottom members 30*a*, 30*b*. The reinforcing member 30*d* is curved into a generally semi-circular shape and extends from a junction between one of the reinforcing members 30*c* and the bottom member 30*b* to a junction between the other of the reinforcing members 30*c* and the bottom member 30*b*. A generally central portion of the reinforcing member 30*d* is disposed in contact with a generally central portion of the top member 30*a*.

As can be seen in FIG. 4, the top and bottom members 30*a*, 30*b* of the side panel 30 are oriented at 90 degrees relative one another. The orientation of the top member 30*a* is such that it allows one of two ends of the support element 22*a* of the hanging file folder 22 to be supported thereon for sliding movement along the top member 30*a* to various positions on the support structure 10 and to be inserted and removed therefrom as desired.

Figure 5:
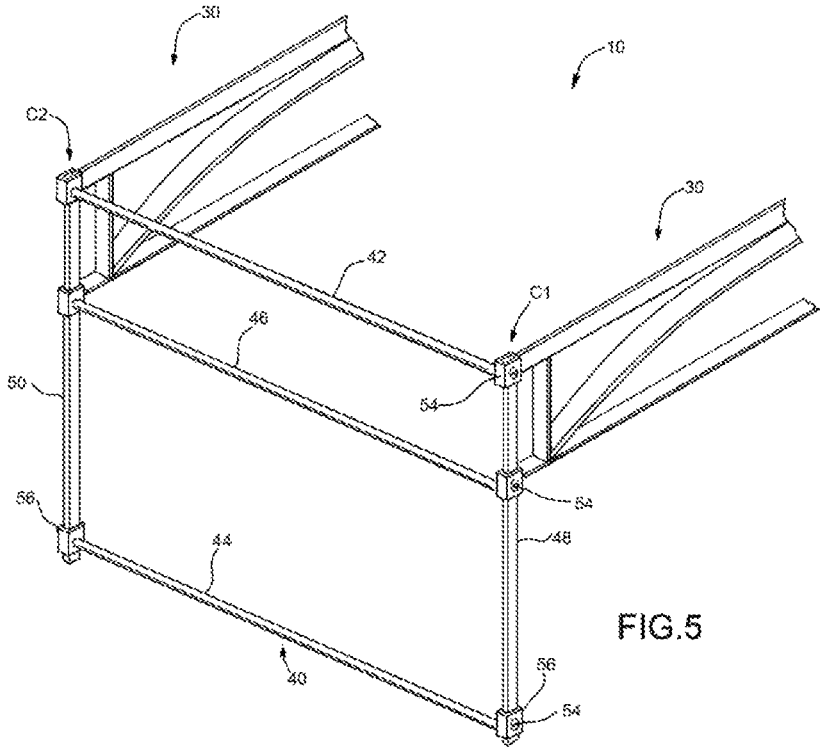
FIG. 5 is a perspective view of another embodiment of the support structure for hanging file folders, partially cut away, according to the present invention.
Figure 6:
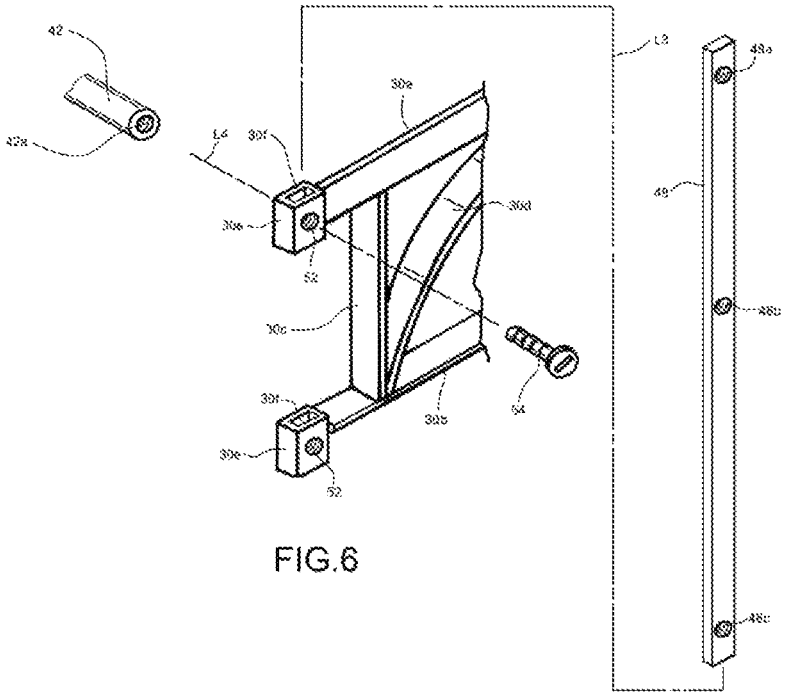
FIG. 6 is an expanded view of a portion of the arrangement in FIG. 5 shown disassembled and partially cut away for further detail.

FIGS. 5-6 illustrate another embodiment of the present invention showing a modified form of the end support frame assemblies, generally designated at 40, of a support structure 10 according to the present invention. For clarity of illustration, in FIGS. 5-6 various components of the support structure 10 are shown partially cut away. The support structure 10 has an open rectangular frame similar to the support structure 10 shown in FIG. 1, including two side panels and two end support frame assemblies (each including two support legs). The two end support frame assemblies 40 in the embodiment of FIGS. 5-6 are identical in dimensions and construction, and thus only one of the end support frame assemblies 40 is described below in connection with this embodiment. Furthermore, the support structure 10 in this embodiment employs two of the side panels 30 as described above for the embodiment of FIG. 4, with the exception of a modification to the connecting members 30*e* as further described below. It is understood, however, that the side panels 12, 14 as described above with reference to FIGS. 1-3, including the modification to the corresponding connecting members, can also be used in place of the side panels 30.

The end support frame assembly 40 includes three transverse support members 42, 44, 46 and two support legs 48, 50. More specifically, the transverse support members include a top (first) rod-shaped member 42, a bottom (second) rod-shaped member 44, and an intermediate (third) rod-shaped member 46 disposed between the top and bottom rod-shaped members 42, 44, each interconnected to the support legs 48, 50 and the side panels 30 as shown in FIG. 4. Each of the top and intermediate rod-shaped members 42, 46 has opposite ends connecting with the respective support legs 48, 50 and the connecting members of the respective top and bottom members of the side panels 30. The opposite ends of the top rod-shaped member 42 connect to upper ends of the respective support legs 48, 50. The opposite ends of the bottom rod-shaped member 44 connect to proximate lower ends of the respective support legs 48, 50. As further described below, each of the opposite ends of each of the top, bottom and intermediate rod-shaped members 42, 44, 46 has a threaded bore.

FIG. 6 is an expanded, partial exploded view of the corner section C1 of the support structure 10 shown in FIG. 5. For clarity of illustration, the rod-shaped member 42 and the side panel 30 are shown partially cut away. Each of the opposite ends of the rod-shaped member 42 is provided with a threaded-bore 42*a*. The support leg 48 is provided with three threaded holes 48*a*, 48*b*, 48*c*. The connecting member 30*e* at the terminal end of each of the top and bottom members 30*a*, 30*b* of the side panel 30 is provided with a threaded hole 52.

With reference to FIGS. 5 and 6, assembly of the corner section C1 is accomplished by inserting the support leg 48 through the vertical slots 30*f* in each of the connecting members 30*e* of the side panel 30, as denoted by chain link line L3, until the threaded holes 48*a*, 48*b* are aligned with the respective threaded holes 52 of the connecting members 30*e*. The threaded bore 42*a* of the top rod-shaped member 42 is then aligned with the aligned threaded holes 48*a* and 52 (corresponding to the connecting member 30*e* of the top member 30*a* of the side panel 30), and a threaded fastener 54 is threaded into the aligned threaded holes 48*a*, 52 and threaded bore 42*a*, as denoted by chain link line L4, to thereby secure the end of the top rod-shaped member 42 and the connecting member 30*e* of the top member 30*a* to the support leg 48 and to one another. Similarly, the threaded hole 48*b*, the threaded hole 52 in the connecting member 30*e* of the bottom member 30*b* of the side panel 30, and the threaded bore (not shown) at one of the ends of the intermediate rod-shaped member 46 are aligned relative one another, and another threaded fastener (not shown) similar to the threaded fastener 54 is threaded into the aligned threaded holes and threaded bore to thereby secure the end of the intermediate rod-shaped member 46 and the connecting member 30*e* of the bottom member 30*b* to the support leg 48 and to one another. The other end of each of the top and intermediate rod-shaped members 42, 46 is secured to the support leg 50 and corresponding connecting members of the other side panel 30 in a manner similar as described above.

The opposite ends of the bottom rod-shaped member 44 are secured to the respective support legs 48, 50 via connecting members 56 and similar threaded fasteners 54. The connecting members 56 are identical in construction to the connecting members 30*e* of the side panel 30 shown in FIG. 6, including vertical slot and threaded hole. However, the connecting members 56 do not form part of any side panel, but are rather separate and independent connecting elements. The end of the bottom rod-shaped member 44 is secured to the support leg 48 proximate the lower end portion thereof. The lower end portion of the support leg 48 is passed through the vertical slot of one of the connecting members 56 until the threaded hole 48*c* is aligned with the threaded hole of the connecting member 56. The threaded bore at the end of the bottom rod-shaped member 44 is then aligned with the aligned threaded hole 48*c* and threaded hole of the connecting member 56, and another threaded fastener 54 is threaded into the aligned threaded holes of the threaded bore to thereby secure the end of the bottom rod-shaped member 44 and the connecting member 56 to the support leg 48 and to one another. The other end of the bottom rod-shaped member 44 is secured to the support leg 50 and the other of the connecting members 56 in a manner similar as described above.

The embodiment of the support structure 10 shown in FIGS. 5-6 does not employ cover members for the upper and lower ends of the support legs as described above for the embodiment of FIGS. 1-3. However, it is understood that the upper and lower ends of the support legs in FIGS. 5-6 may also be covered with such cover members to achieve the benefits previously described. In this case, the length of the support legs and/or the position of the threaded hole at the upper end of each of the support legs may be varied accordingly so that the upper end of the support leg protrudes from the connecting member 30*e*, and the protruding upper end is covered with one of the cover members.

It will be appreciated that, in the assembled state, the support structure 10 according to the embodiment shown in FIGS. 5-6 provides a stable, open frame configuration that is sufficiently strong to support and hang therefrom a number of hanging file folders when the support structure 10 is mounted within the file drawer 20 (FIG. 2). The components of the support structure 10 described above with reference to the embodiment of FIGS. 5-6 may be formed of materials similar to those described above with reference to embodiments of FIGS. 1-3 and 4.

Figure 7A:
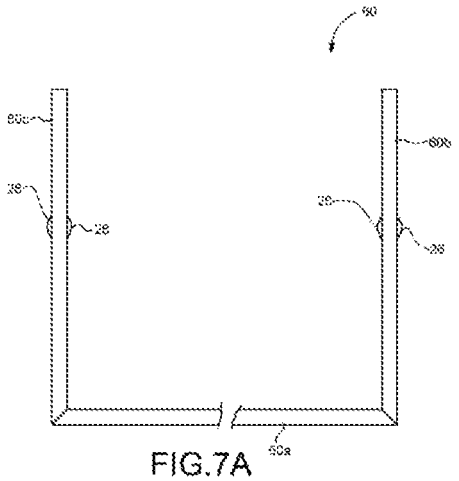
FIG. 7A is a front view of a modified form of the end support frame assembly, partially cut away, for the support structure for hanging file folders according to the present invention.
Figure 7B:
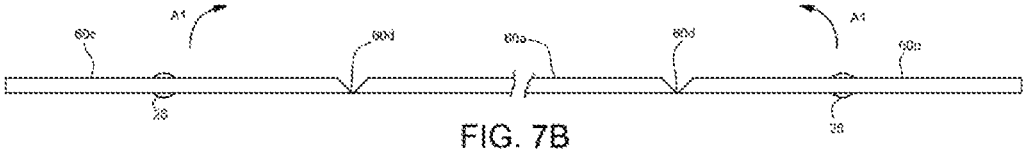
FIG. 7B is a front view of the end support frame assembly, partially cut away, shown in FIG. 7A depicted in a mode prior to being assembled into the configuration shown in FIG. 7A.
Figure 8:
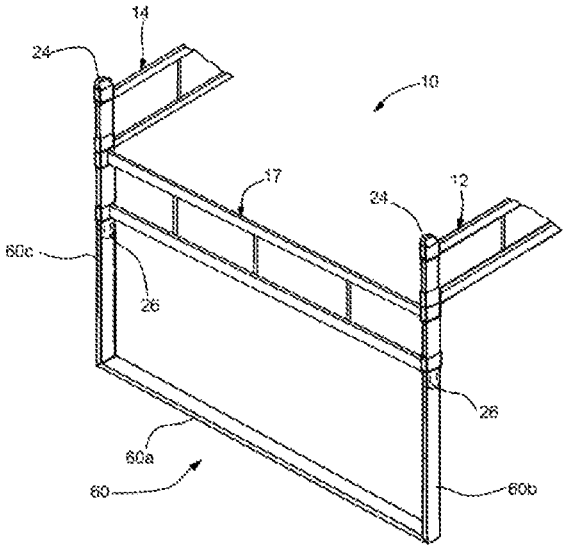
FIG. 8 is a perspective view of a support structure for hanging file folders, partially cut away, employing the end support frame assembly shown in FIG. 7A.

FIGS. 7A-7B and 8 illustrate another embodiment of the present invention showing another modified form of the end support frame assemblies, generally designated at 60, of a support structure 10 according to the present invention. For clarity of illustration, in FIGS. 7A-7B and 8 various components of the support structure 10 are shown partially cut away. The support structure 10 has an open, rectangular frame construction similar to the support structure 10 shown in FIG. 1, including two side panels and two end support frame assemblies. The two end support frame assemblies 60 are identical in construction to one another, and thus only one of the end support frame assemblies 60 is described below in connection with this embodiment. Furthermore, the support structure 10 in this embodiment employs the side panels 12, 14 and one of the transverse support members 17 as described above for the embodiment of FIGS. 1-3. It is understood, however, that in this embodiment side panels having the structure of the side panel 30 shown in FIG. 4 may be substituted for the side panels 12, 14.

Referring to FIGS. 7A-7B, the end support frame assembly 60 differs from the end support frame assemblies 16, 18 (FIGS. 1-3) and 40 (FIGS. 5-6) described above in that the end support frame assembly 60 is of a unitary construction. More specifically, in the assembled state shown in FIG. 7A, the end support frame assembly 60 has a generally U-shaped configuration and is formed of a transverse support member (e.g., a horizontally extending bar) 60*a* and two spaced apart corner posts 60*b*, 60*c* interconnected by the transverse support member 60*a*. The transverse support member 60*a* is configured to rest on the surface of the file drawer 20 (FIG. 2). The corner posts 60*b*, 60*c* function as the support legs described above for the end support frame assemblies of the embodiments of FIGS. 1-3 and 5-6.

Each of the support legs 60*b*, 60*c* is provided with indentations 26 formed on opposite surfaces and disposed approximately at a central portion thereof. As described above for the embodiment of FIGS. 1-3, the indentations 26 serve to position and retain the transverse support member 17 relative to the support legs 60*b*, 60*c* so as to prevent the transverse support member 17 from displacing in a direction toward lower ends of the support legs 60*b*, 60*c*.

Referring to FIG. 7B, the end support frame assembly 60 is preferably formed of a flat strip of material and includes a pair of notched portions 62*d* (bending points) separating the transverse support member 60*a* from the support legs 60*b*, 60*c*. The support legs 60*b*, 60*c* are configured to be bent at the notched portions 60*d* in the direction denoted by arrows A1 to form the end support frame assembly 60 into the U-shaped configuration shown in FIG. 7A.

Assembly of the support structure 10 shown in FIG. 8 is accomplished in a manner similar to the support structure 10 described above with reference to FIGS. 1-3, except as described below. The transverse support member 17 is first mounted on the end support frame assembly 60 by passing the support legs 60*b*, 60*c*, via the upper end thereof, through the respective vertical slots of the connecting members of the transverse support member 17 until the connecting members at the respective terminal ends of the bottom member of the transverse support member 17 firmly engage and rest on the respective indentations 26 provided on the support legs 60*b*, 60*c*. Each of the side panels 12, 14 is then mounted on the end support frame assembly 60 by passing the support legs 60*b*, 60*c*, via the upper ends thereof, through the respective vertical slots of the connecting members of the side panels 12, 14 until the connecting members at the respective terminal ends of the bottom members of the side panels 12, 14 firmly engage and rest on the respective connecting members at the respective terminal ends of the top member of the transverse support member 17. The exposed upper end of each of the support legs 60*b*, 60*c* is then covered with a cover member 24, as described above for the embodiment of FIGS. 1-3. A similar procedure is followed to assemble the other end support frame assembly (not shown), which is identical to the end support frame assembly 60 described above, relative to the side panels 12, 14 and to another transverse support member 17.

The support structure 10 according to the embodiment shown in FIGS. 7A-7B and 8 can be assembled with a reduced number of parts. This is accomplished by forming each of the end support frame assemblies 60 with a unitary construction as described above. Furthermore, by forming the end support frame assembly 60 with the transverse support member 60*a* which is unitary with the support legs 60*b*, 60*c*, only one transverse support member 17 (as compared to two for the embodiment of FIGS. 1-3) is required to interconnect the support legs 60*b*, 60*c* and provide overall stability and support to the support structure 10. The components of the support structure 10 according to the embodiment of FIGS. 7A-7B and 8 may be formed of materials similar to those described above with reference to the embodiments of FIGS. 1-3, 4 and 5-6.

Figure 9:
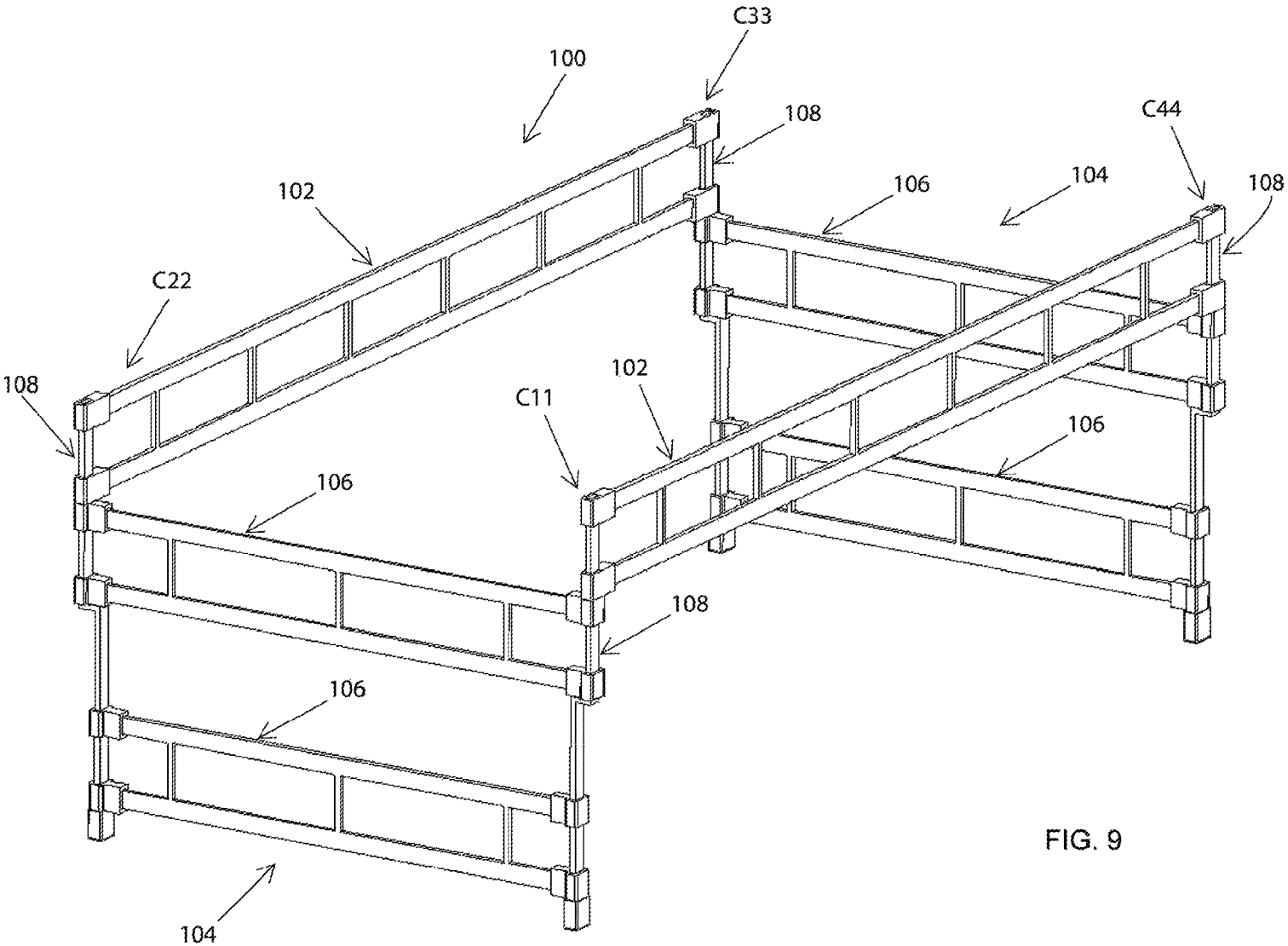
FIG. 9 is a perspective view showing an arrangement of the support structure for hanging file folders according to another embodiment of the present invention as assembled for use.

FIGS. 9-14 illustrate another embodiment of a support structure for hanging file folders, generally designated at 100, according to the present invention. FIG. 9 shows the support structure 100 in the assembled state. Support structure 100 is formed of interlocking components including a pair (first and second) of elongate side panels 102 and a pair (first and second) of end support frame assemblies 104 removably connected together to form an open box-type structure having four corner sections C11, C22, C33 and C44. Support structure 100 is configured to be placed in a conventional file drawer for supporting hanging file folders (file pockets). As described above for the exemplary embodiment of FIG. 2, the hanging file folders are provided with support elements for slidably engaging the side panels 102 so that the hanging file folders may be moved to various positions on the support structure 100 and may be inserted and removed as desired. In this exemplary embodiment, elongate side panels 102 are identical in construction and dimension to one another and end support frame assemblies 104 are identical in construction and dimension to one another.

Referring to FIGS. 9-12, each end support frame assembly 104 includes a pair of support legs or posts 108 and upper and lower transverse support members 106 releasably mounted to respective ones of the support legs 108. Each transverse support member 106 includes a top member 106*a*, a bottom member 106*b* and multiple (e.g., three in this exemplary embodiment) reinforcing members 106*c* interconnecting the top and bottom members. Top and bottom members 106*a*, 106*b* have opposite (first and second) terminal ends each formed as a connecting member 110 for removably connecting transverse support members 106 to respective support legs 108. In this embodiment, each connecting member 110 is formed unitarily (i.e., in one piece) of two generally rectangular-shaped portions 110*a*, 110*b* in orthogonal relation to one another. Portion 110*a* has a vertical slot 110*c* for receiving therethrough support leg 108, and portion 110*b* has a blind hole 110*d* for receiving therein an end of corresponding top 106*a*/bottom member 106*b* of transverse support member 106. In an alternative embodiment, connecting members 110 may be unitary (i.e., formed in one piece) with corresponding top 106*a*/bottom 106*b* members of transverse support member 106, thereby reducing the number of parts of support structure 100.

Side panels 102 are adapted to span the distance between support end assemblies 104. Each side panel 102 includes a top member 102*a*, a bottom member 102*b* and multiple (e.g., six in this exemplary embodiment) reinforcing members 102*c* interconnecting the top and bottom members. Top members 102*a* are configured to releasably and slidably support elements of hanging file folders as described above for the exemplary embodiment shown in FIG. 2. Top and bottom members 102*a*, 102*b* have opposite (first and second) terminal ends each formed as a connecting member 112 for removably connecting the top and bottom members to respective support legs 108. Each connecting member 112 has a vertical slot 112*d* for receiving therethrough support leg 108 and a blind hole 112*e* for receiving therein an end of corresponding top 102*a*/bottom member 102*b* of side panel 102. In an alternative embodiment, connecting members 112 may be unitary (i.e., formed in one piece) with corresponding top 102*a*/bottom 102*b* members of side panel 102, thereby further reducing the number of parts of support structure 100.

Figure 10:
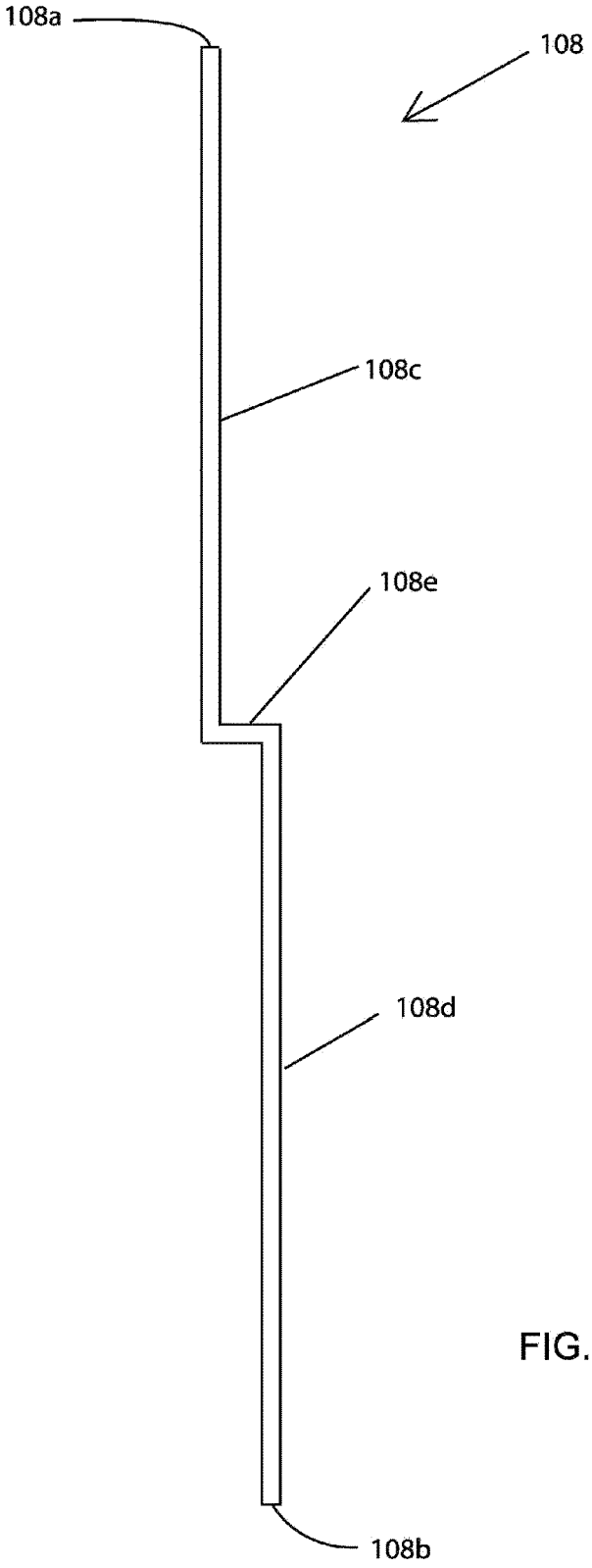
FIG. 10 is a front elevational view of a support leg for the support structure shown in FIG. 9.

FIG. 10 is a front elevational view of support leg 108 for each corner section C11, C22, C33, C44. Support leg 108 has opposite terminal ends 108*a*, 108*b* and two leg portions 108*c*, 108*d* extending between the terminal ends. In the configuration of support 100 according to this exemplary embodiment, terminal ends 108*a*, 108*b* correspond to upper and lower ends, respectively, of support leg 108, with leg portion 108*c* having upper end 108*a* and leg portion 108*d* having lower end 108*b*. Lower end 108*b* of each support leg 108 is covered with a cover or shoe member 114. Specifically, cover member 114 has a vertical slot 114*a* for receiving therein lower end 108*b* of support leg 108. In this embodiment, cover member 114 is removably secured to lower end 108*b* of support leg 108 with a friction fit.

Leg portions 108*c*, 108*d* are spaced apart from one another by a bend 108*e* provided between terminal ends 108*a*, 108*b* such that leg portions 108*c*, 108*d* extend generally parallel to one another. As further described below, bend 108*e* serves as a seat for positioning and holding the corresponding upper transverse support member 106 relative to support leg 108 so as to prevent the upper transverse support member from displacing in a direction toward terminal end 108*b* of support leg 108.

An example of the manner of assembling corner section C11 of support structure 100 is described with reference to FIGS. 10-14.

Figure 11:
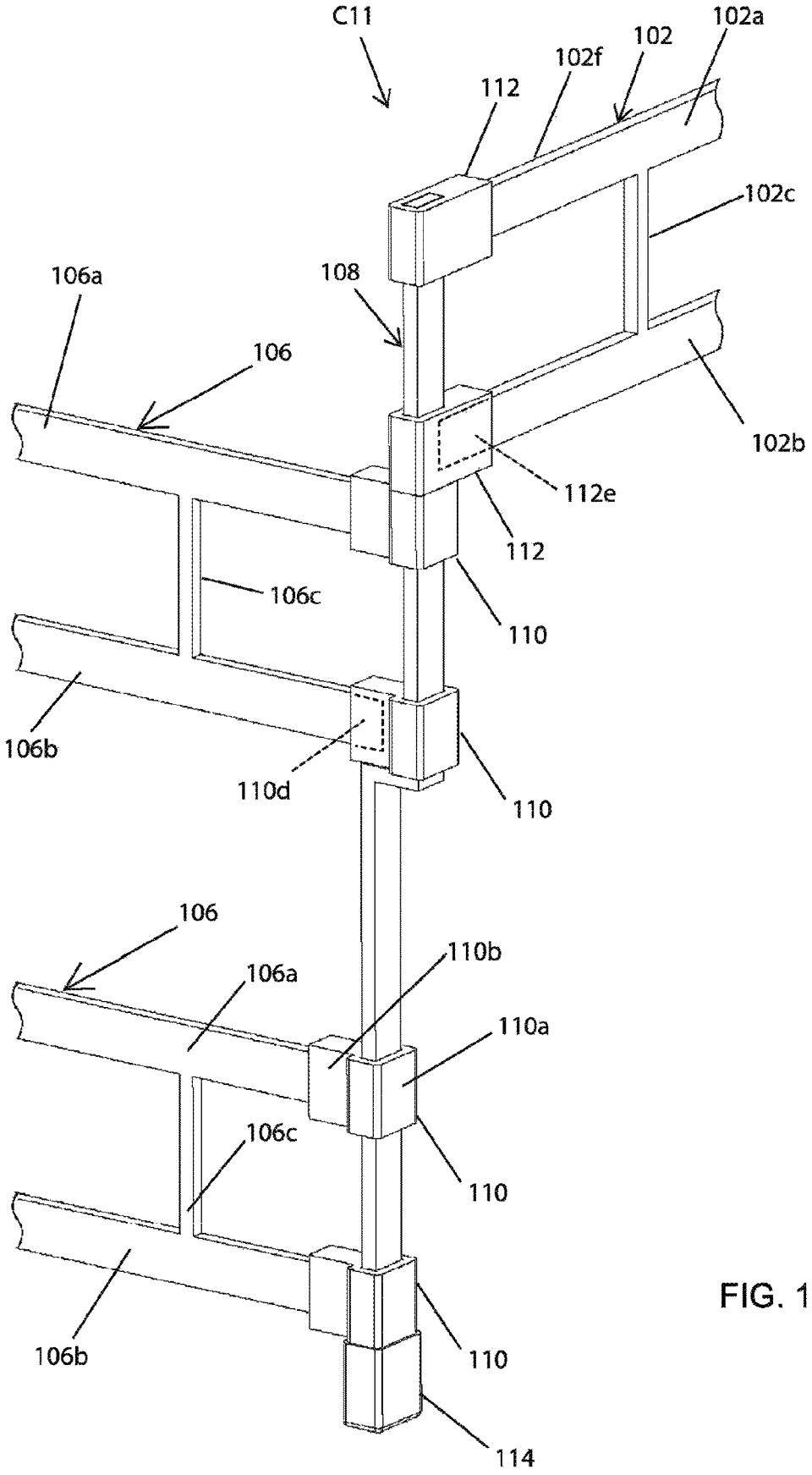
FIG. 11 shows a portion of the arrangement of the support structure shown in FIG. 9.
Figure 12:
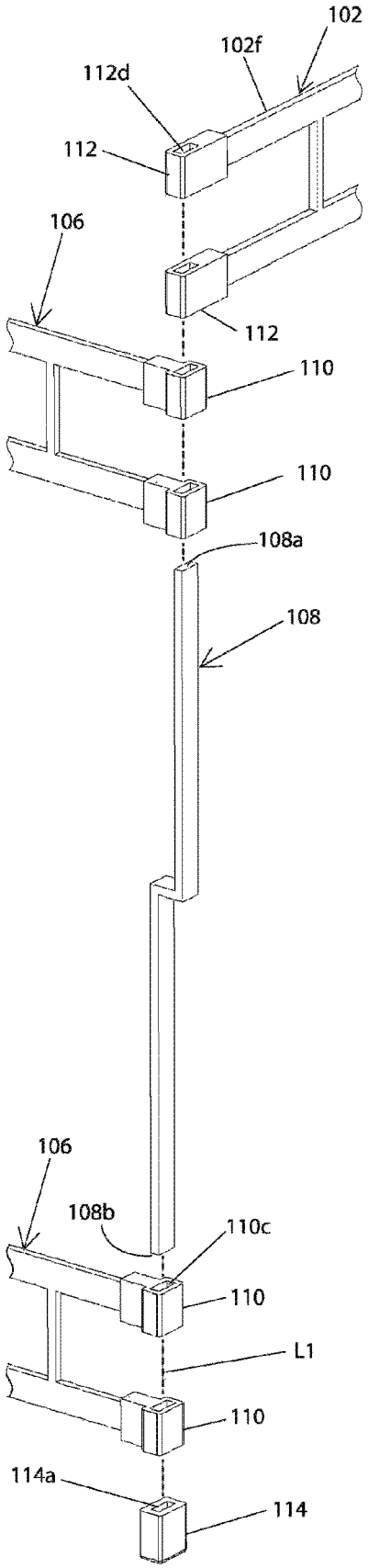
FIG. 12 is an exploded view of the portion of the arrangement of the support structure shown in FIG. 11.
Figure 13:
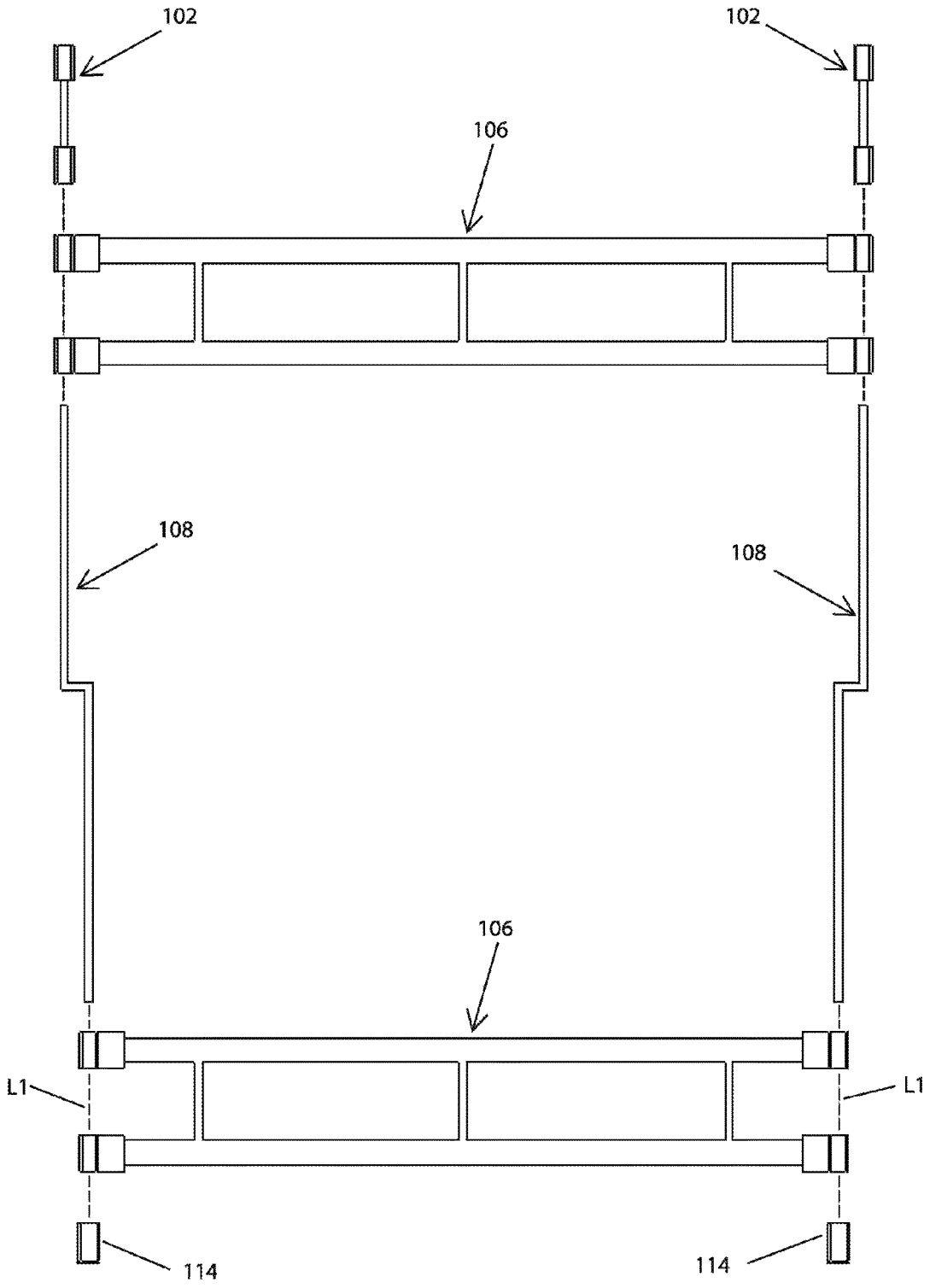
FIG. 13 is an exploded, front elevational view of the end support frame assembly of the support structure shown in FIG. 9.

Initially, connecting members 110 and 112 are mounted to corresponding ends of top 106*a* and bottom 106*b* members and corresponding ends of top 102*a* and bottom 102*b* members of transverse support members 106 and side panel 102, respectively. Lower transverse support member 106 is then mounted on support leg 108 by passing leg portion 108*d* of support leg 108, from lower end 108*b* thereof, through vertical slots 110*c* of connecting members 110 provided to top 106*a* and bottom 106*b* members of lower transverse support member 106, as denoted by chain link line L1 in FIG. 12. The lower end 108*b* is positioned so as to extend through vertical slot 110*c* of connecting member 110 provided to bottom member 106*b*, and cover member 114 is thereafter removably secured to lower end 108*b* (FIG. 11). Upper transverse support member 106 is then mounted on support leg 108 by passing leg portion 108*c* of support leg 108, from upper end 108*a* thereof, through vertical slots 110*c* of connecting members 110 provided to top 106*a* and bottom 106*b* members of upper transverse support member 106, as denoted by chain link line L1 in FIG. 12. In this state, upper transverse support member 106 is displaced along leg portion 108*c* of support leg 108 until connecting member 110 provided to bottom portion 106*b* of upper transverse support member 106 firmly engages and rests on seat 108*e* of support leg 108. Thereafter, side panel 102 is mounted on support leg 108 by passing leg portion 108*c* of support leg 108, from upper end 108*a* thereof, through vertical slots 112*d* of connecting members 112 provided to top 102*a* and bottom 102*b* of side panel 102 until connecting member 112 provided to bottom member 102*b* of side panel 102 rests on connecting member 110 provided to upper member 106*a* of upper transverse support member 106, and upper end 108*a* of support leg 108 is generally flush with a side surface of connecting member 112 provided to top member 102*a*. In this configuration, the terminal ends of upper 106*a* and lower 106*b* members of upper transverse support member 106 are interposed between seat 108*e* of support leg 108 and connecting member 112 provided to the terminal end of lower member 102*b* of side panel 102.

It will be appreciated that the foregoing assembly operation is both simple and quick. The completely assembled corner section C11 of support structure 100 described above is shown in FIG. 11. The same procedure is followed to assemble corner sections C22, C33 and C44 to complete assembly of support structure 100 shown in FIG. 9.

Figure 14:
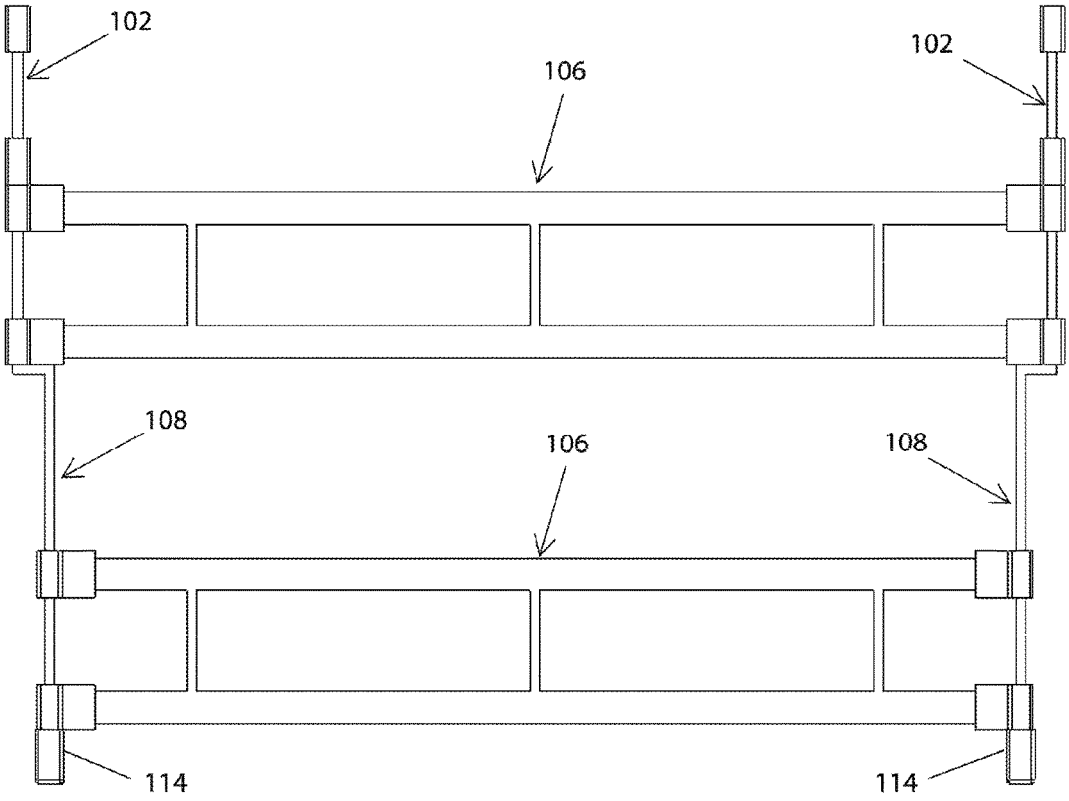
FIG. 14 is a front elevational view of the end support frame assembly in FIG. 13 shown in an assembled state.

It will be appreciated that in the assembled configuration of corner sections C11, C22, C33 and C44 shown in FIGS. 9, 11 and 14, seat 108*a* provided in each support leg 108 serves to position and retain the terminal end of bottom member 106*b* of upper transverse support member 106 so as to prevent displacement thereof toward lower end 108*b* of support leg 108. Furthermore, connecting members 110 of upper and lower transverse support members 106, connecting members 112 of side panel 102, and cover member 114 are configured to engage leg portions 108*c*, 108*d* of support leg 108 with a friction fit. By this arrangement, secure corner sections C11, C22, C33 and C44 providing overall structural integrity to support structure 100 are achieved. It will be understood by those skilled in the art that assembly of each corner section C22, C33 and C44 of support structure 100 can be accomplished using the same procedure described above for the assembly of corner section C11.

It will be appreciated from the foregoing description with reference to FIGS. 9-14 that side panels 102 are identical in construction and dimensions, upper and lower transverse support members 106 of support frame assemblies 104 are identical in construction and dimensions, support legs 108 are identical in construction and dimensions, connecting members 110 are identical in construction and dimensions, connecting members 112 are identical in construction and dimensions, and cover members 114 are identical in construction and dimensions. By this construction, mass production of the various parts for support structure 100 is facilitated.

Moreover, the configuration of side panels 102 and transverse support members 106, including the top and bottom members separated by the reinforcing members and including terminal ends formed with the connecting members having slots configured for receiving the respective support legs, advantageously serve to add rigidity to support structure 10 by substantially reducing lateral stress on corner sections C11, C22, C33 and C44 of support structure 100. Furthermore, any torsional stress that support structure 100 is likely to encounter is resisted by virtue of the configuration of side panels 102 and transverse support members 106 and by these components being mounted on support legs 108 passing through respective slots of the connecting members provided to terminal ends of these components.

It will also be appreciated that assembly of support structure 100 according to the embodiment shown in FIGS. 9-14 can be readily accomplished in a quick and detachable manner without the use of tools and without the need for screws or other extraneous fasteners. Furthermore, by the above construction, side panels 102 and end support frame assemblies 104 can be readily assembled to form support structure 100 either in a filing cabinet drawer within which it is used or out of the drawer for placement therein. By providing the terminal ends of the top and bottom members of the side panels and transverse support members with connecting members having vertical slots and providing the support legs with seats, as described above, these parts can be readily and securely assembled to construct the corner sections of the support structure 100 so that the parts cannot be disassembled when handling the support structure during insertion into a file cabinet drawer or when loaded with hanging folders. However, the construction of support structure 100 according to this embodiment allows it to be readily disassembled by hand for storage and to be reassembled for use in another file cabinet drawer. Moreover, support structure 100 can be constructed with a minimum number of parts as compared to conventional support structures for hanging file folders. In this regard, the total number of parts for support structure 100 can be reduced even further by forming connecting members 110 and 112 unitarily (i.e., in one piece) with transverse support members 106 and side panels 102, respectively, as set forth above. The various parts of support structure 10 according to the present embodiment is therefore particularly adapted for packaging as a kit.

Preferably, side panels 102, transverse support members 106, support legs 108 and connecting members 110, 112 of support structure 100 are constructed from a metal, such as aluminum or steel, which may be in stamped, cast, machined or extruded form. For example, these parts may be fabricated from flat strip metal of uniform section with smooth edges throughout. Alternatively, these parts may be constructed of comparatively strong rigid plastic or other material. The cover or shoe members 114 are preferably made of rubber or similar material to protect the file drawer within which support structure 100 is installed from damage and/or the user from injury.

It will be appreciated by those skilled in the art that the support structure for hanging file folders according to the foregoing embodiments of the present invention may be readily assembled into a strong, rigid structure which is self-supporting and self-retaining in use so as to be extremely efficient and sturdy for the supporting of hanging file folders. The support structure may be easily and readily assembled and disassembled by a user without requiring special tools. The support structure may also be manufactured economically from a small number of separate components, can be shipped and stored in compact, knock-down form, and is capable of easy and rapid assembly into a rigid structure for use.

While the present invention has been described in terms of specific embodiments of support structures for hanging file folders, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

I claim:

1. A support structure for hanging file folders, the support structure comprising:

a pair of support frame assemblies each comprised of a pair of support legs and at least one transverse support member having opposite terminal ends releasably mounted to respective ones of the pair of support legs, each of the support legs having a first leg portion and a second leg portion spaced apart from the first leg portion by a bend serving as a seat for positioning and holding the at least one transverse support member; and a pair of side panels interconnecting the pair of support frame assemblies in spaced apart relationship along a length direction of the support structure, the side panels having terminal ends releasably mounted to respective ones of the first leg portions of the respective support legs, each of the side panels having a top member for releasably supporting one of two ends of a support element of one or more hanging file folders;

wherein for each of the support frame assemblies, the at least one transverse support member comprises a top member, a bottom member spaced apart from the top member, and at least one reinforcing member interconnecting the top and bottom members; and wherein each of the terminal ends of the transverse support member is formed as a connecting member having a slot for releasably receiving therethrough the first leg portion of the support leg.

2. The support structure of claim 1, wherein for each of the support frame assemblies, the opposite terminal ends of the at least one transverse support member are releasably mounted to the first leg portion of the corresponding support leg.

3. The support structure of claim 2, wherein the at least one transverse support member is interposed between the corresponding side panel and the seat of the corresponding support leg.

4. The support structure of claim 1, wherein the first and second leg portions of each support leg are generally parallel to one another.

5. The support structure of claim 1, wherein for each of the support frame assemblies, the at least one transverse support member comprises a first transverse support member, and further comprising a second transverse support member having opposite terminal ends releasably mounted to the second leg portions of the support legs.

6. The support structure of claim 1, wherein the support frame assemblies are identical in construction to one another.

7. The support structure of claim 1, wherein the side panels are identical in construction to one another.

8. The structure of claim 1, wherein each of the side panels has a bottom member spaced apart from the top member and at least one reinforcing member interconnecting the top and bottom members.

9. A support structure for hanging file folders, the support structure comprising:

a pair of support frame assemblies each including a pair of support legs and a transverse support member having opposite terminal ends releasably mounted to respective ones of the first support legs, each of the support legs having a first leg portion and a second leg portion spaced apart from the first leg portion by a bend serving as a seat for positioning and holding the transverse support member, the transverse support member having a top member, a bottom member spaced apart from the top member and at least one reinforcing member interconnecting the top and bottom members in spaced-apart relation to one another, each of the terminal ends of the transverse support member having a slot releasably receiving therethrough the first leg portion of the corresponding support leg so that the terminal end is disposed on the seat of the corresponding support leg; and a pair of side panels interconnecting the pair of support frame assemblies in spaced apart relationship along a length direction of the support structure, each of the side panels having a top member for releasably supporting one of two ends of a support element of one or more hanging file folders, a bottom member spaced apart from the top member, and at least one reinforcing member interconnecting the top and bottom members, each of the top and bottom members having first terminal ends each formed as a connecting member having a slot for releasably receiving the first leg portion of the corresponding support leg of the corresponding support frame assembly.

10. A support structure for hanging file folders, the support structure comprising: a pair of elongate side panels and a pair of end support frame assemblies for maintaining the side panels in a mutually spaced relationship and at an elevation to enable suspension of hanging file folders from upper surfaces of the side panels, each of the side panels includes a top member having the upper surface, a bottom member spaced apart from the top member, and at least one reinforcing member interconnecting the top and bottom members, each of the top and bottom members having opposite terminal ends each formed as a connecting member having a vertical slot, each of the end support frame assemblies includes a pair of support legs configured to extend into the vertical slots of the respective connecting members of the side panels and including a transverse support member having opposite terminal ends configured to be releasably mounted to respective ones of the support legs, each of the support legs having a first leg portion and a second leg portion spaced apart from the first leg portion by a bend serving as a seat for positioning and holding the transverse support member.

11. The support structure of claim 9, wherein the first and second leg portions of each support leg are generally parallel to one another.

12. The support structure of claim 9, wherein the support frame assemblies are identical in construction to one another; and wherein the side panels are identical in construction to one another.

13. The support structure of claim 9, wherein each of the side panels, transverse support members, support legs and connecting members are constructed from a metal material.

14. The support structure of claim 9, wherein each of the side panels, transverse support members, support legs and connecting members are fabricated from flat strip metal of uniform section with smooth edges throughout.

15. The support structure of claim 9, wherein each of the side panels, transverse support members, support legs and connecting members are constructed from a strong rigid plastic material.

16. The support structure of claim 10, wherein the first and second leg portions of each support leg are generally parallel to one another.

17. The support structure of claim 10, wherein the support frame assemblies are identical in construction to one another; and wherein the side panels are identical in construction to one another.

18. The support structure of claim 10, wherein each of the side panels, transverse support members, support legs and connecting members are constructed from a metal material.

19. The support structure of claim 10, wherein each of the side panels, transverse support members, support legs and connecting members are fabricated from flat strip metal of uniform section with smooth edges throughout.

20. The support structure of claim 10, wherein each of the side panels, transverse support members, support legs and connecting members are constructed from a strong rigid plastic material.

* * * * *